US006549110B1

(12) United States Patent
Baltes

(10) Patent No.: US 6,549,110 B1
(45) Date of Patent: Apr. 15, 2003

(54) COMPENSATING DEVICE SUITABLE FOR USE IN RAILWAY CAR TRANSFORMERS

(75) Inventor: Herbert Baltes, Losheim (DE)

(73) Assignee: Hydac Technology GmbH, Sulzbach/Saar (DE)

( * ) Notice: Subject to any disclaimer, the term of this patent is extended or adjusted under 35 U.S.C. 154(b) by 0 days.

(21) Appl. No.: 09/806,327

(22) PCT Filed: Jul. 23, 1999

(86) PCT No.: PCT/EP99/05269

§ 371 (c)(1),
(2), (4) Date: Mar. 29, 2001

(87) PCT Pub. No.: WO00/22633

PCT Pub. Date: Apr. 20, 2000

(30) Foreign Application Priority Data

Oct. 14, 1998 (DE) ..... 198 47 313

(51) Int. Cl.[7] ..... H01F 27/08
(52) U.S. Cl. ..... 336/60; 336/58; 336/55
(58) Field of Search ..... 336/55, 58, 60

(56) References Cited

U.S. PATENT DOCUMENTS 2,016,247 A * 10/1935 Simmons
3,448,219 A * 6/1969 Nakazawa et al.
4,609,900 A 9/1986 Bachhofer et al.

FOREIGN PATENT DOCUMENTS

CH 436 468 A 11/1967
EP 0 743 661 A 11/1996

* cited by examiner

*Primary Examiner*—Anh Mai
(74) *Attorney, Agent, or Firm*—Roylance, Abrams, Berdo & Goodman, L.L.P.

(57) ABSTRACT

A compensating device suitable for use in railway car transformers has at least one compensation receptacle in fluid communication connection with the interior of the housing of a transformer and having a fluid volume. A separating element limits the fluid volume in the compensation receptacle. When a change occurs in the fluid volume in the compensation receptacle, the separating element is subject to a change in position. The separating element is designed in the form of a roll-over membrane. The circumferential edge of the membrane is connected to the side walls of the compensation receptacle at a distance form the bottom of the receptacle in a sealing manner. The connection is such that the roll-over membrane, in its rolled-up state, has a position in which it allows for the largest amount of fluid volume by substantially extending in one plane at a distance form the bottom. The membrane can be rolled-out from this position so as to approach the side walls and bottom in the compensation receptacle, reducing the fluid volume.

12 Claims, 2 Drawing Sheets

Fig. 3
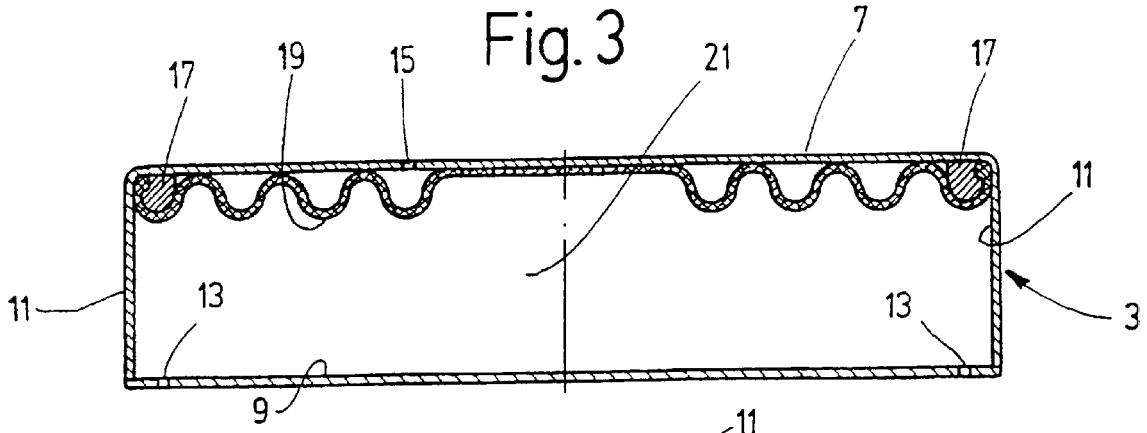
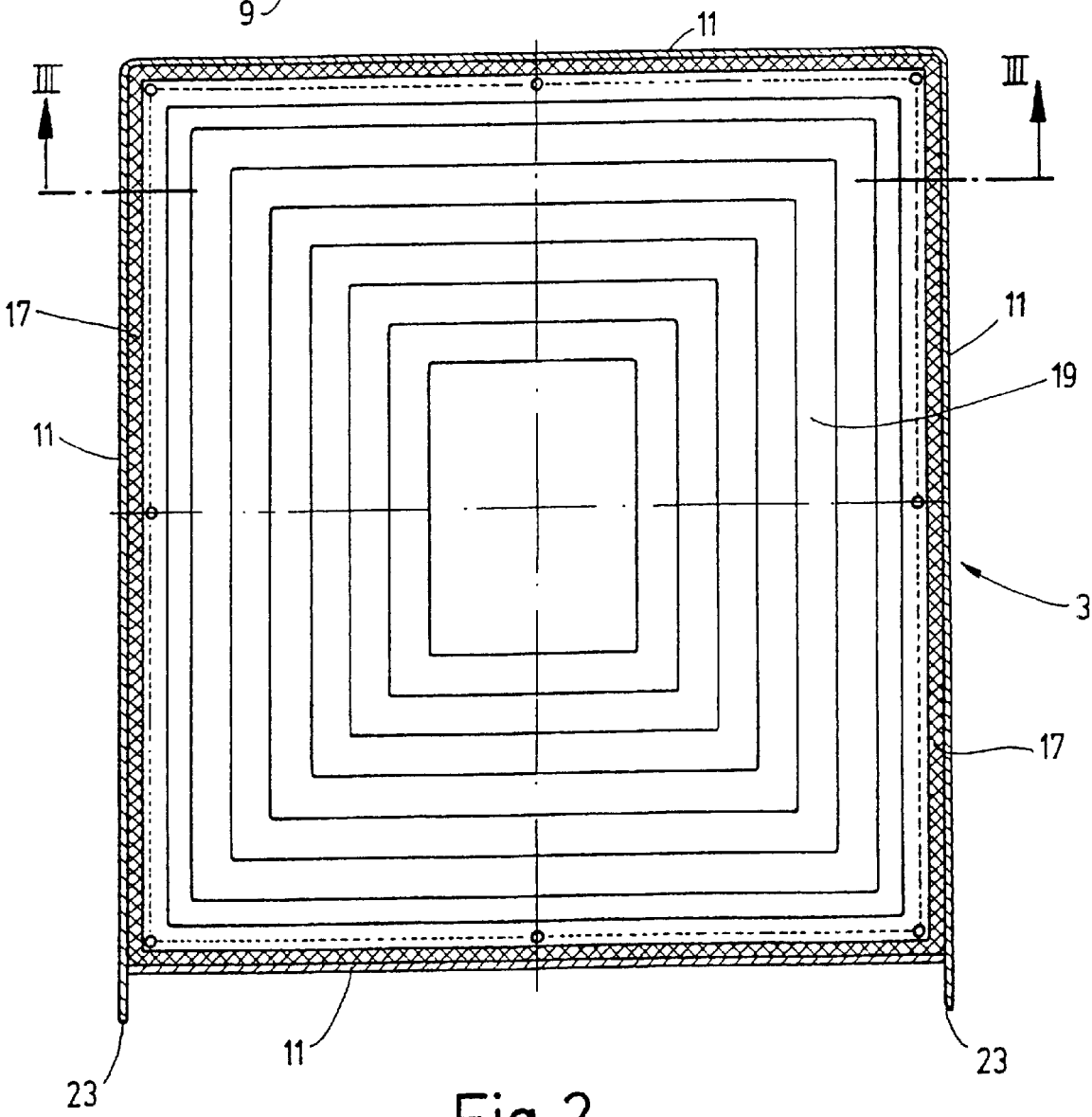
Fig. 2

COMPENSATING DEVICE SUITABLE FOR USE IN RAILWAY CAR TRANSFORMERS

FIELD OF THE INVENTION

The present invention relates to a compensating device suitable for use in railway car transformers having at least one compensation receptacle. The compensation receptacle has a fluid-carrying connection with the interior of the housing of the transformer, carries a fluid volume, and has a separating element limiting the fluid volume in the compensation receptacle. The separating element is in the form of a membrane having a circumferential border connected with and sealed to the side walls of the compensation receptacle at some distance form its bottom. With modification of the fluid volume in the compensation receptacles, the separating element is subject to modification of its position.

BACKGROUND OF THE INVENTION

Work temperatures of from −30 degrees C. to 135 degrees C. prevail during the operation of transformers in railway cars. The fluid used as transformer fluid, generally in the form of silicon oil, is subject to volume fluctuations of greater than 10%. In order to be able to compensate for these temperature-dependent volume fluctuations, a compensation receptacle is conventionally provided which can store transformer fluid and can deliver the transformer fluid through a fluid-carrying connection into the interior of the housing of the transformer when low operation temperatures prevail. During operation at high temperatures, it can carry transformer fluid out of the housing of the transformer.

In order to be able to fulfill this function, one compensation receptacle is disclosed in EP 0 743 661 A3. A vertically movable guided compensating plate is arranged in the compensation receptacle. The plate serves as a separating element, separating the fluid volume of different magnitudes in the compensating receptacle form the ambient atmosphere. To guide the movement of the compensating plate, two sheathings are provided in the compensation receptacle which slide relative to one another. One sheathing is fastened to remain stationary. The other sheathing is fastened to the compensating plate. A spring arrangement located within the sheathing produces a prestressing or servo-force, seeking to move the compensating plate in the direction corresponding to the diminution of volume.

This device of EP 0 743 661 A3 is costly to manufacture, and is of complicated construction which is a considerable disadvantage. Since transverse acceleration in the magnitude of 5 g can occur with the use of such compensating devices in transformers for the operation of railway cars, the sheathing and spring arrangement, in the compensation receptacle forming the movable positioning of the compensation plate, must be manufactured very carefully. Construction is costly, if the predetermined tolerances are to be maintained to avoid disruptions of operation when transverse acceleration occurs. On the other hand, the location of the sheathing and spring arrangement in the interior of the compensation receptacle leads to a dead space of considerable volume, because the guiding obtained by the sheathings moving relative to one another allows for only a limited length of passage for the movement of the compensating plate. As a result, a very unfavorable ratio results between structural dimensions of the compensation receptacle and magnitudes of variable fluid volume remaining available as compensation space.

A compensating device disclosed in U.S. Pat. No. 4,609,900 is suitable for use with small-format, high voltage transformers, and provides a membrane as separating element. The separating element is guided by means of a spring-biased guide member within the compensation receptacle. In the position corresponding to the smallest volume of fluid, the membrane extends into the intermediate space between the container interior wall and the guide member against the bottom of the compensation receptacle. With wave movements of the guiding member occurring counter to the spring force form the bottom, the non-expandable membrane is laid out in the intermediate space between the receptacle interior wall and guide member in an unrolling folding over upon itself. Also, with this compensating device of this type, a very unfavorable ratio exists between structural dimensions and the volume remaining available as compensation space. Additionally, the use of a spring-biased guide member guided on the housing leads to a complicated and costly construction.

SUMMARY OF THE INVENTION

Objects of the present invention are to provide a compensation receptacle which can be manufactured of simpler construction and at low cost, and which is characterized by an improved ratio between structural dimensions and variable compensation volumes. In a compensating device, these objects according to the present invention are attained in that a roll-over membrane having waves is provided as the membrane. The membrane can be rolled out with pulling flat of the waves. Correspondingly, in its rolled-up state, the membrane extends in a position freeing the greatest volume of fluid, essentially in a plane at some distance form the bottom.

According to the present invention, utilization of a roll-over membrane as separating element on the one hand facilitates particularly simple construction and correspondingly greatly decreased manufacturing costs for the compensation receptacle. On the other hand, it provides the advantage that nearly the entire volume of the compensation receptacle, without having a dead space volume present and without dropping in weight, is available as variable compensation volume. This is attained in that the roll-over membrane is of such dimensions that it extends in rolled-up state practically in a plane in which it frees essentially the entire interior space of the compensation receptacle for the fluid volume, and that it can be unrolled out of this position into a trough-like or cup-like configuration in which it is closely adjacent to the interior surface of the compensation receptacle, in other words to the bottom and the side walls. Thus, an especially good ratio between structural dimensions of the compensation receptacle and dimensions of usable compensation volume is attained.

A compensation device disclosed in CH-A-436 368 has a membrane as a separating element, which is not expandable. The membrane is of a metal foil, on both sides of which is applied a plastic foil. The missing expandability of the membrane prevents it from extending to the position corresponding to the greatest fluid volume in a plane at some distance from the bottom. This device is much rather configured as a spherical vessel in which the membrane is hollowed out convexly or concavely in a trough-like manner.

Another particular advantage of the compensation device according to the present invention involves using compensation receptacles, produced in a simple and low-cost method of construction, for the operation of the relevant transformer by a plurality of quite small-volume compensation receptacles provided in a modular arrangement. When using a plurality of small-volume compensation receptacles constructed together in modular construction to form a modular compensation device associated with a transformer, the disturbing influence of the sloshing of the transformer fluid in the compensation receptacle, as it occurs in conventional compensation devices, is reduced. With the conventional devices, measures must be taken in order to suppress the destructive influences of the sloshing occurring with the presence of transverse acceleration caused by the springing expansion working on the movable compensation plate, which presses the compensation plate on the fluid surface. With the present invention, on account of its subdivision of the compensation arrangement into a plurality of small partial volumes, no measures for the suppression of the sloshing effects are required. Thus, it is not required that the roll-over membrane represent a stabilizing element to counter the sloshing. The surface of the roll-over membrane without any further difficulty can be of such dimensions that even in an entirely rolled-out state, it corresponds to the smallest fluid volume, having dimensions which are only slightly smaller than the interior surface of the compensation receptacle defining the fluid volume. The roll-over membrane, even in the state of the smallest fluid volume (in other words in completely rolled-out state), stands under only a slight tensile stress.

The modular construction of the compensating device made up of a plurality of compensation receptacles arranged on the transformer housing permits suitable grouping of the compensation receptacles. Free spaces on the top surface of the transformer housing can then be used for cable through-conductance or the like.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure:

FIG. 2 is a top plan view, in section and in larger scale, of one of the compensation receptacles of FIG. 1, likewise without top cover; and FIG. 3 is a side elevation view in section of the compensation receptacle taken along line III—III of FIG. 2, but with its top sealed cover replaced.

DETAILED DESCRIPTION OF THE INVENTION

Figure 1:
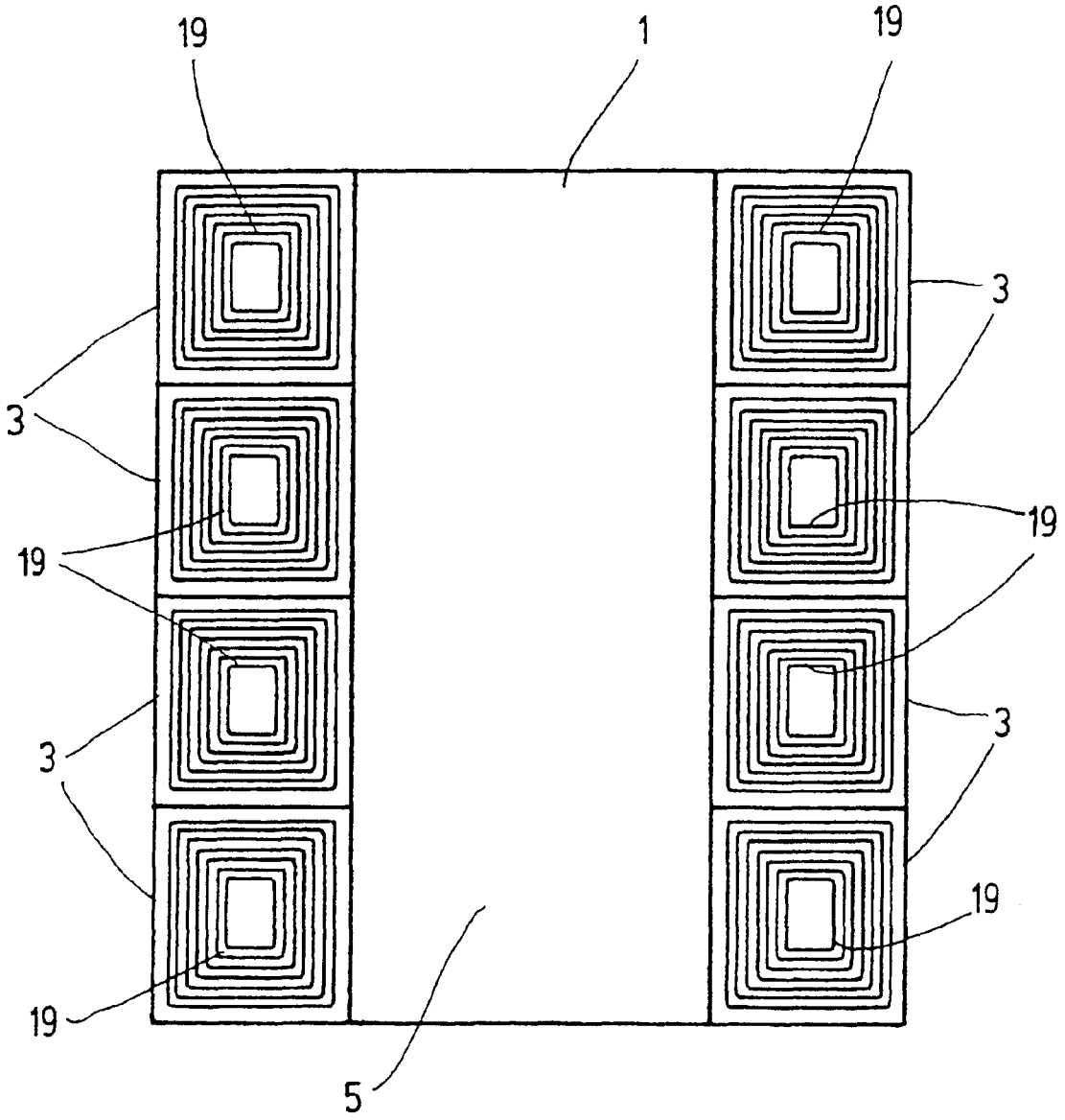
FIG. 1 is a diagrammatically simplified, top plan view of a transformer housing with compensation receptacles arranged on its top surface in two side groupings to comprise the compensation device according to the present invention, with top sealed coverings of the compensation receptacles removed.

In FIG. 1 the housing 1 of a transformer is filled with transformer fluid 1. On the top of housing 1, eight compensation receptacles in modular construction are arranged in two side groups of four each to form a compensating device according to the present invention. Between the two groups of compensation receptacles 3, a free space 5 remains on the top of housing 1. The free space, for example, can be used for cable through-conductance or conduit when limited space ratios are provided, in the underfloor construction used with railway cars. Compensation receptacles 3 are in turn configured as caissons having identical rectangular foundation plates, and are illustrated in FIGS. 1 and 2 without their top sealed covers, which cover 7 is seen only in FIG. 3.

FIGS. 2 and 3 shown the individual unit of a compensation receptacle 3 in greater detail. The side walls 11 of the receptacle stand parallel to one another in pairs, extending perpendicularly from bottom or bottom wall 9. For the formation of a fluid-carrying connection with the interior space of housing 1 of the transformer, flat bottom 9 is provided with boreholes 13. Cover 7 forming the top sealing of the caisson-shaped compensation receptacle 3 likewise has boreholes 15 for ventilation of the space beneath cover 7.

A frame 17 is screwed into engage with, to extend along the bottom of cover 7, and to fit to the interior of the top edges of side walls 11. The circumferential border of a roll-over membrane 19 is fastened to frame 17, and is sealed off from the interior surfaces of side walls 11. Frame 17, however, can also be fastened and sealed directly onto cover 7.

Roll-over membrane 19, is shown in the drawings in its rolled-up state, in which it extends essentially in a plane along the bottom of top cover 7. It can be rolled out by a pressure differential resulting in the pulling out flat of its waves or folds. The membrane assumes a trough-like or cup-like configuration as it approaches bottom 9 and the interior surfaces of side walls 11 of compensation receptacle 3. The magnitude of fluid volume 21 found beneath roll-over membrane 19 varies in this case between a value corresponding to almost the entire volume of caisson-shaped compensation receptacle 3 and a comparably very small remainder volume. In other words practically the entire interior space of compensation receptacle 3 can stand accessible as compensation volume for inflow or discharge of fluid through boreholes 13. During the compensation movements of roll-over membrane 19, the space found between it and cover 7 is ventilated through boreholes 15 in cover 7. A valve-operated ventilation mechanism can be series-connected with the boreholes 15 to avoid polluting environmental influences.

The compensating device can be constructed in modular construction in such a manner that the longitudinal sides of the groups formed of compensation receptacles 3 are formed by side walls 11 passing all the way through. In FIG. 2, the right- and left-side walls 11 mounted on the exterior are represented as broken off at 23. The individual compensation receptacles 3 in turn are compartmentalized by side walls 11 running transverse to one another. Likewise the transverse arrangement of side walls 11 for the formation of modules could be passing all the way through two or more compensation receptacles 3.

Roll-over membrane 19 is manufactured of an elastomeric material, for example a suitable synthetic rubber material, and preferably is reinforced with webbing inserts. A plastic foil coating can be provided on at least one membrane surface by lamination to improve the fluid impenetrability. Preferably, the surface of roll-over membrane 19 is of such dimensions that even in completely rolled-out state, it remains under only a minimal tension, which, despite the moments during operation when the temperature is as high as possible, allows for a particularly long operation life.

Specifically, the membrane in the rolled-out or flattened state has a planar bottom portion defined between vertical portions of the membrane adjacent side walls 11. The bottom portion has a surface area which is approximately 4 to 8 percent, and preferably about 6 percent, smaller than the surface area of bottom 9 between side walls 11.

While a particular embodiment has been chosen to illustrate the invention, it will be understood by those skilled in the art that various changes and modifications can be made therein without departing from the scope of the invention as defined in the appended claims.

What is claimed is:

1. A compensating device usable with railway car transformers, comprising:

at least one compensation receptacle having a port in fluid communication with an interior of an associated transformer housing, and having side walls and a bottom wall;

a fluid volume enclosed within said receptacle; and a separating element within said receptacle limiting said fluid volume in said receptacle, said separating element being a roll-over membrane having a circumferential border sealingly connected to said side walls at a distance spaced from said bottom wall, said membrane having waves;

whereby, upon modification of said fluid volume, position of said membrane is modified such that said membrane extends substantially in a plane in a rolled-up state with said waves at a distance from said bottom wall when said receptacle contains a maximum fluid volume, and such that said membrane is in a rolled-out state with flattening of said waves and with said membrane located adjacent said bottom wall when said receptacle contains a minimum fluid volume.

2. A compensating device according to claim 1 wherein said receptacle is a caisson with said side walls extending from said bottom wall in pairs parallel to one another in each pair;

said bottom wall comprises a flat, rectangular plate; and said circumferential border of said membrane is connected to said side walls adjacent top borders thereof.

3. A compensating device according to claim 2 wherein a cover is mounted at said top borders of said side walls; and said membrane has top surface areas, remote from said fluid volume, engaging said cover in said rolled-up state of said membrane.

4. A compensating device according to claim 3 wherein said part comprises an opening in said bottom wall; and said cover comprises at least one opening for ventilating said top surface areas of said membrane.

5. A compensating device according to claim 1 wherein said membrane in said rolled-out state has a substantially planar bottom portion defined between vertical portions of said membrane adjacent said side walls, said bottom portion having a surface area which is approximately 4 to 8 percent smaller than a surface area of said bottom wall between said side walls.

6. A compensating device according to claim 5 wherein said surface area of bottom portion is approximately 6 percent smaller than said surface area of said bottom wall.

7. A compensating device according to claim 1 wherein said membrane is made of elastomeric material.

8. A compensating device according to claim 7 wherein said elastomeric material is reinforced by a webbing insert.

9. A compensating device according to claim 7 wherein said membrane is coated on at least one surface thereof with a plastic foil.

10. A compensating device according to claim 9 wherein said plastic foil is laminated on said membrane.

11. A compensating device according to claim 1 wherein a plurality of identically configured compensation receptacles are arranged on a top surface of the transformer housing.

12. A compensating device according to claim 11 wherein said compensation receptacles are grouped on the transformer housing to define therebetween a surface area extending completely across said top surface of the transformer housing free of other equipment elements and defining a through cable conduit.

* * * * *